United States Patent [19]

Spence

[11] 4,317,739

[45] Mar. 2, 1982

[54] AMINATED SULFURIZED OLEFIN FUNTIONALIZED WITH A BORON COMPOUND AND FORMALDEHYDE

[75] Inventor: J. Ronald Spence, Bartlesville, Okla.

[73] Assignee: Standard Oil Company (Indiana), Chicago, Ill.

[21] Appl. No.: 196,029

[22] Filed: Oct. 10, 1980

[51] Int. Cl.[3] ..... C10M 1/38

[52] U.S. Cl. ..... 252/47.5; 252/49.6; 260/125; 260/132

[58] Field of Search ..... 252/47.5, 49.6, 47, 252/46.3, 45; 260/125, 132

[56] References Cited

U.S. PATENT DOCUMENTS

| | | | |
|---|---|---|---|
| 2,290,316 | 7/1942 | Cook | 260/132 X |
| 2,652,367 | 9/1953 | Adelson | 252/47.5 X |
| 2,783,205 | 2/1957 | Brooks et al. | 252/47 X |
| 3,213,076 | 10/1965 | Budde, Jr. | 260/132 |
| 3,442,808 | 5/1969 | Traise et al. | 252/49.6 |
| 3,470,098 | 9/1969 | O'Halloran | 260/132 X |
| 3,600,327 | 8/1971 | Hu | 252/47.5 X |
| 4,210,545 | 7/1980 | Lee et al. | 252/47 |

*Primary Examiner*—Andrew Metz

*Attorney, Agent, or Firm*—Mark DiPietro; William T. McClain; William H. Magidson

[57] ABSTRACT

Corrosive wear caused by aminated sulfurized olefins can be reduced by reaction of the aminated sulfurized olefine with a boron compound and formaldehyde.

7 Claims, No Drawings

AMINATED SULFURIZED OLEFIN FUNTIONALIZED WITH A BORON COMPOUND AND FORMALDEHYDE

This invention relates to novel mixed organic-inorganic compositions which provide a variety of beneficial properties to lubricating oils used in internal combustion engines. More particularly, this invention relates to novel sulfurized aminated olefins which provide dispersancy and antioxidant activity to lubricating oils and to novel, practical methods for their preparation.

Lubricating oil additives that provide beneficial properties to lubricating oils include dispersants that are capable of limiting formation of deposits in internal combustion engines by suspending in the oil dirt, insoluble combustion byproducts, etc. One such dispersant is an aminated sulfurized olefin (an animated trithione) which is produced by sulfurizing an olefin and reacting the sulfurized olefin with an amine. The aminated sulfurized olefin, like many lubricant additives, is an amorphous reaction product containing a large number of individual products, each somewhat different than the others, that often contains small but harmful amounts of reaction byproducts including free amine and sulfur which can cause unacceptable corrosion and wear in the engine.

Accordingly, a need exists for an aminated sulfurized olefin, which provides dispersancy in the absence of the severe corrosive wear problems caused by reaction byproducts.

The general object of this invention is to improve the properties of lubricating oils with novel mixed organic-inorganic additive compositions. Another object of this invention is to provide an improved aminated sulfurized olefin composition that provides dispersancy in the absence of unacceptable corrosion and wear. Another object of the invention is to provide a novel process for the efficient preparation and purification of the sulfurized aminated olefin compounds. Further objects appear hereinafter.

I have discovered aminated sulfurized olefins that provide dispersancy to lubricating oils without causing harmful corrosion and wear to engine surfaces can be produced by reacting an aminated sulfurized olefin with a boron compound and formaldehyde or formaldehyde-yielding compound. Apparently, the boron compound reacts with the corrosive free sulfur-containing moieties to produce substantially noncorrosive sulfur containing moieties. I also believe that the formaldehyde reacts with corrosive amine moieties in the additive composition providing essentially noncorrosive nitrogen containing moieties.

Briefly, the novel additives of this invention are prepared by the reaction of an olefin, a sulfur or sulfur-yielding compound, an amine, a boron compound and formaldehyde or a formaldehyde-yielding compound.

Boron compounds useful for the preparation of the sulfurized aminated olefins of this invention include boric acid (ortho boric acid, Boracic acid, $H_3BO_3$), tetraboric acid ($H_2B_4O_7$), meta boric acid ($HBO_2$), and salts thereof including ammonium borate, amine salts of boric acid, sodium borate, potassium borate, calcium borate, magnesium borate, metaborate salts, etc.; boron oxides such as $B_2O_3$, $B_3O_7$, etc.; boron salts such as boron arsenate, etc. For reasons of high activity and low cost, boric acid ($H_3BO_3$) and salts thereof, and boron oxide and oligomers thereof, including mixtures thereof, are preferred boron compounds.

Olefins having 10 to 10,000 carbon atoms useful in the preparation of the sulfurized aminated olefins of this invention comprise mono- or polyunsaturated hydrocarbons including olefins recovered from refinery streams, atactic amorphous polyolefins, etc. These olefins include decene, t-decene, 2-decene, dodecene, eicosene, etc. Atactic or substantially amorphous olefinic polymers produced by polymerization of low molecular weight olefins are also useful to prepare the novel additives. The polyolefins can be obtained by contacting an olefin or mixtures of olefins generally in liquid phase with a catalyst such as sulfuric acid, boron trifluoride, aluminum chloride, Ziegler-Natta or other similar catalysts well known in the art. Preferably, olefinic polymers can be derived from monoolefins including ethylene (ethene), propene (propylene), 1-butene, 2-butene, isobutylene (2-methyl-propene) octadecene, $C_{4-15}$ conjugated dienes, or $C_{5-15}$ non-conjugated dienes including butadiene or 5-ethylidene norbornene, etc. Preferred amorphous polymers include ethylene-propylene copolymers, ethylene-propylene-diene terpolymers, ethylene-propylene-5-ethylidene-2-norbornene terpolymers, polyisobutylene, polybutene, etc., or mixtures thereof. The olefins can have a molecular weight from about 150 to about 140,000 or greater. Preferably, polymers having a molecular weight from about 300 to about 100,000 are useful for reasons of economy, reactivity, and availability.

Sulfur compounds useful for producing the aminated sulfurized olefins of this invention include solid, particulate, or molten forms of elemental sulfur or sulfur-yielding compounds such as sulfur monochloride or sulfur dichloride. Other sulfur-yielding compounds include hydrogen sulfide, phosphorus pentasulfide, etc. Fine particulate or molten elemental sulfur is preferred for reasons of ease of handling, high reactivity, availability, and low cost.

Amines useful in preparing the aminated sulfurized olefins of this invention include aliphatic amines and polyamines having a general formula $NH_2(CH_2)_yNH_2$ wherein y is an integer of 3–12; polyalkylene polyamines of the general formula $NH_2[(CH_2)_z—NH]_xH$, wherein z is an integer of 2–6 and x is an integer of 1–10. Illustrative of suitable amines are methylamine, butylamine, cyclohexylamine, propylamine, decylamine, ethylenediamine, diethylenetriamine, trimethylenediamine, tetramethylenediamine, hexamethylenediamine, diethylenetriamine, triethylenetetraamine, tetraethylenepentamine, tripropylenetetraamine, tetrapropylenepentamine and other polyalkylenepolyamines in which the alkyl group contains about 12 carbon atoms or mixtures thereof. Other useful polyamines are bis(aminoalkyl)-piperizine, bis(aminoalkyl)ethylene diamine, bis-(aminoalkyl)propylene diamine, N-aminoalkyl morpholine, 1,3-propane polyamines, and polyoxypolyamines.

Conventional formaldehyde-yielding reagents can be used, for example, formaldehyde, formalin, paraformaldehyde, trioxane, etc., or mixtures thereof.

In somewhat greater detail, the novel products of this invention can be produced by reacting the olefin, sulfur or sulfur-yielding compound, an amine and the boron compound and the formaldehyde or formaldehyde-yielding compound simultaneously. However, to afford reaction control and improved product, the following reaction sequence is preferred: (a) reacting the olefin and the sulfur to produce a sulfurized olefin; (b) reacting the sulfurized olefin with an amine to produce an aminated sulfurized olefin; and (c) reacting the aminated sulfurized olefin with the boron compound and the formaldehyde or formaldehyde-yielding compound to produce the corrosion-free lubricant additive.

About 0.1–20 moles of sulfur or sulfur-yielding compound can be reacted with the olefin per mole of olefin compound. Preferably, from about 2–6 moles of sulfur are reacted with the olefin per mole of olefin compound to provide essentially complete sulfurization. The temperature range of the sulfurization reaction is generally about 50°–500° C. preferably about 100°–250° C. The most prefered temperature range is between about 150°–200° C. for reasons of rapid reaction rate and reduced decomposition of reactants. Frequently, the sulfurization can be run in the presence of catalysts which are added to the reaction mixture to increase yield and rate of reaction. These catalysts include acidified clays, paratoluene sulfonic acid, dialkylphosphorodithioic acid, and a phosphorus sulfide.

The olefin or polyolefin can be either mechanically or oxidatively degraded prior to reaction with sulfur or amine. Mechanical degradation is commonly performed in well-known processes in apparatus, such as a blender or a homogenizer, directing high shear forces on the polymer solution. The mechanical degradation reduces viscosity and adjusts molecular weight to a desired level. Oxidative degradation is commonly performed by contacting the polymer in solution with oxidants such as oxygen-containing gas to introduce carbonyl, aldehyde, alcohol and other oxygen-containing groups into the polymer chain. The oxygen-containing groups produce active sites, on carbon atoms alpha to the oxygen-containing group, that participate in a variety of reactions useful for production of derivatives of the polymer.

The time required to complete the sulfurization will vary depending on the ratios of reactants, reaction temperature, catalyst and purity of reagents. The course of reaction is conveniently monitored by following reaction vessel pressure or hydrogen sulfide evolution. The reaction can be considered complete when pressure levels off or evolution of hydrogen sulfide begins to decline.

If desired, volatile materials can be removed by stripping the sulfurized olefin with an inert gas at an elevated temperature for a period of time so that substantially all volatile materials have been removed. The reaction product can also be filtered or centrifuged to remove undesirable particulate matter.

The sufurized olefin can be reacted with from about 0.1–20 moles of amine per mole of olefin, preferably about 0.1–2 moles of amine per mole of olefin is used for reasons of high dispersancy and low cost of the resultant product. The amination reaction is commonly performed at a temperature between about 50°–400° C., preferably at a temperature of about 150°–200° C. for reasons of rapid reaction and low degradation of products. While the reaction time is variable depending on purity, concentration and ratio of reactants, the reaction commonly is complete in about 2–24 hours. Volatile and particulate materials can be conveniently removed at this point.

The sulfurization or amination can produce great quantities of the tarry byproducts which can contaminate the product and prevent filtration and other purification steps.

The removal of tarry byproduct of the olefinsulfur-amine reaction can be promoted by performing the amination or sulfurization reaction in the presence of an alkali metal or an alkaline earth metal compound. About 0.1–20 moles of the alkali metal or alkaline earth metal compound can be added to the reaction mixture simultaneously with the sulfur or sulfur-yielding compound or the amine. Sodium hydroxide, lithium chloride, potassium chloride, calcium oxide, calcium hydroxide, magnesium oxide, or magnesium hydroxide, barium hydroxide, calcium carbonate, barium chloride, etc. can be added to the reaction mixture. Apparently, the alkali metal or alkaline earth metal compounds react with or absorb the tarry reaction byproducts and reduce the sticky-tacky character of the tarry material. The tarry-metal oxide product then precipitates and can be easily removed by washing, filtration or centrifugation.

Commonly, the alkali metal or alkaline earth metal compound can be added simultaneously with the amine, prior to the amine, or after the amine. However, the best results are obtained when the alkaline earth metal is added prior to or simultaneously with the amine compound.

The aminated sulfurized olefin product is then reacted with the boron compound and formaldehyde or formaldehyde-yielding compound. The boron compound and the formaldehyde compound can be reacted separately, however, they can be reacted simultaneously without harm to the properties of the product.

The boron compound and formaldehyde or formaldehyde-compound can be conveniently added in solid form or in aqueous solution or organic suspension. Preferably, the compounds are added in aqueous solution at an appropriate temperature. About 0.1 to about 10 moles each of the boric acid compound or the formaldehyde or formaldehyde-yielding compound can be contacted per mole of the aminated sulfurized olefin. Preferably, greater than a stoichiometric amount of boric acid or formaldehyde compound (about 1.1–5.0 moles each) of boron compound and formaldehyde compound per mole of the olefin compound can be reacted to produce an aminated sulfurized olefin dispersant having the lowest corrosivity and highest dispersancy. The reaction can be run at temperatures from about 50° C. to about 300° C. However, the reaction is preferably run at a temperature of about 100° to about 150° C. to reduce degradation and improve processing.

Depending on reactant purity, reactant ratios, temperatures and agitation, the reaction commonly can be completed in about 2 to 24 hours. At the end of the reaction, water and other volatile materials can be stripped by heating and passing an inert stripping gas through the reaction mixture. Commonly, the mixture is then filtered through celite to remove undesirable precipitate.

The reactions detailed above can be performed in batch or continuous mode. In batch mode, the reactant or reactants and appropriate diluent are added to a suitable vessel for reaction. At the end of the reaction, the product is then withdrawn to appropriate strippers, filters, and other purification apparatus. In continuous mode, a stream of reactants is continuously combined at an appropriate rate and ratio in a vertical or horizontal reaction zone maintained at the reaction temperature. The reaction mixture stream is continuously withdrawn from the zone and is directed to appropriate strippers or purification apparatus.

The reactions can be run neat (solventless) or in inert solvents or diluents such as hexane, heptane, benzene, toluene, lubricating oil, petroleum fractions, kerosene, lingroin, petroleum ether, etc. Water soluble components such as boric aid, boric oxides, formaldehyde or formaldehyde-yielding compound, and others can be dissolved in water for convenient handling. The reactions can be run at atmospheric or superatmospheric pressures maintained by gases evolved during reaction or by inert gas blankets such as nitrogen or carbon dioxide as pressurizing gases.

The above reaction products of the present invention are effective additives for lubricating oil compositions when used in amounts of from about 0.1 to 90 weight percent based on the oil. Suitable lubricating base oils are mineral oils, petroleum oils, synthetic lubricating oils such as those obtained by the polymerization of hydrocarbons and other well known synthetic lubricating oils, and lubricating oils of animal or vegetable origin. Concentrates of the additive composition of the invention in a suitable base oil containing about 10 to 90 weight percent of the additive based on the oil, alone or in combination with other well known additives, can be used for blending with the lubricating oil in proportions designed to produce finished lubricants containing 0.01 to 20 weight percent of the product.

The additives of this invention are often evaluated for ability to prevent wear and engine deposits in the L-38 bearing corrosion, 1H2 Diesel and VD gasoline engine tests.

The following examples and tables of data are illustrative of methods used in preparation of the additives and applications of the additives. The examples should not be used to unduly limit the scope of the invention.

EXAMPLE I

Into a 5-liter three-neck flask equipped with a nitrogen inlet tube and wet test meter was placed 1379 grams (0.61 moles) of polyisobutylene having a molecular weight of about 2240, and 119.65 grams (3.75 moles) of elemental sulfur. The mixture was heated and stirred to a temperature of 185° C. under an inert nitrogen blanket. At 185° C. the flask was connected to the wet test meter and $H_2S$ evolution was measured. The temperature of the mixture was raised to 200° C. for 8 hours. During this time, about 36 liters of hydrogen sulfide were evolved. At the end of this time, the temperature was raised to 230° C. and 2 cubic feet per hour of nitrogen gas was passed through the product for 2 hours to remove volatile materials. The product contained 2.91 weight percent sulfur, about 93.4 percent of the product contained polar groups attributed to sulfur.

EXAMPLE II

Into a 5-liter three-neck flask equipped with a nitrogen inlet tube, water trap, stirrer and heater were charged 100 grams of the sulfurized product of Example I, 41.47 grams (0.22 moles) of tetraethylene pentamine, 295 grams of 5 W oil, 75 grams (1.3 moles) of magnesium hydroxide, 27.5 milliliters of water and 400 milliliters of xylene. The mixture was stirred and heated for 30 minutes to a temperature of 85° C. and water was removed azeotropically. The temperature was increased to 165° C. for 4 hours and then increased to 185° C. for 30 minutes. The solution was cooled and diluted with xylene and filtered. The filtered solution was placed in a 5-liter, three-neck flask and 12.3 grams of boric acid in 200 milliliters of water were added. The mixture was stirred for 30 minutes and heated to a temperature of 85° C. and water was removed. The solution was filtered; solvents were stripped by distillation. The product contained 1.03 percent nitrogen, 1.32 percent sulfur, and 43.95 percent was polar.

TABLE I

| VD ENGINE TEST (LC 2007) | | (Passing) |
|---|---|---|
| Average Sludge | 9.73 | (9.2) |
| Piston Varnish | 7.51 | (7.0) |
| Average Varnish | 7.42 | (6.8) |

Test oil formulation: 7.00 wt.% product of Example II, 1.29 wt.% overbased magnesium sulfonate, 2.03 wt.% zinc dialkyldithiophosphate, 7.90 wt.% dispersant VI improver, 0.7 wt.% VI improver, 0.12 wt.% antifoam, balance lube oil.

EXAMPLE III

Into a 5-liter three-neck reaction flask equipped with a reflux condenser, stirrer, heater, nitrogen atmosphere and water trap were charged about 3,127 grams (1.4 moles) of polyisobutylene polymer, molecular weight about 2,240, and 300 grams (9.4 moles) sulfur. The mixture was stirred and reacted at 240° C. for 8 hours. The mixture was cooled and was ready for use. The product contained 3.9 wt.% sulfur.

Into a five-liter reaction flask equipped with a nitrogen atmosphere, water trap, stirrer and heater were charged 1,573.5 grams of sulfurized material prepared above, 394 grams of 5 W oil, 68.8 grams (0.37 moles) of tetraethylene pentamine, 138 grams (2.4 moles) of magnesium hydroxide, 80 milliliters of water, and 500 milliliters of xylene. The mixture was stirred and heated to a temperature of 85° C. for 30 minutes. Water was removed azeotropically from the mixture and the temperature was raised to 165° C. for 4 hours and then raised to 185° C. for 30 minutes. The solution was cooled and diluted with xylene and filtered. The filtered solution was returned to the flask and reacted with 36 grams (0.58 moles) of boric acid in 260 milliliters of water and 90 milliliters of 37 weight percent formalin. The mixture was stirred and heated to a temperature of 85° C. for 30 minutes. Water was removed azeotropically. The solution was filtered and solvents were removed by distillation.

TABLE II

| L-38 BEARING CORROSION TEST | | |
|---|---|---|
| Bearing Weight Loss | 16.7 mg | (40 mg passing) |

Test Oil Formulation: 5 wt.% product of Example III, 0.70 wt.% of a calcium sulfurized phenate, 0.90 wt.% overbased magnesium sulfonate, 1.5 wt.% zinc dialkyl dithiophosphate, 11.0 wt.% dispersant VI improver, 0.3 wt.% VI improver, balance lubricating oil.

EXAMPLE IV

Into a 5-liter three-neck flask equipped with a nitrogen atmosphere, water trap, stirrer and heater were charged 4073 grams of sulfurized material from Example I in 5 W oil, 142.46 grams (0.77 moles) of tetraethylene pentamine, 286 grams (5.4 moles) of magnesium hydroxide, 165 milliliters of water, and 840 milliliters of xylene. The mixture was stirred and heated to a temperature of 85° C. for 30 minutes as water was removed azeotropically. The temperature was raised to 165° C. for 4 hours and then raised to 185° C. for 30 minutes. The solution was cooled and diluted with xylene and filtered. The filtered solution was replaced in the flask and reacted with 24 milliliters of 37 weight percent formaldehyde and 69.8 grams (1.1 moles) of boric acid in 300 milliliters of water. The mixture was stirred and heated to 85° C. for 30 minutes as water was removed azeotropically. The solution was stripped and filtered and was ready for use.

TABLE III

| 1H2 DIESEL ENGINE TEST | |
|---|---|
| Top groove fill (TGF) | 1% (less than 40 passing) |
| Carbon demerits (WTC) | 11.75 |
| Lacquer demerits (WLD) | 148.5 |
| Total demerits (WTD) | 160.2 (less than 140 passing) |

Test Oil Formulation: 4.1 wt.% product of Example IV, 1.75 wt.% zinc dialkyl dithiophosphate, 0.90 wt.% overbased magnesium sulfate, balance lubricating oil.

An examination of Tables I, II and III shows that the products of the examples are effective lubricant additives. Table I shows acceptable passing scores in the sequence VD engine test. Table II shows an acceptable passing L-38 bearing corrosion test, and Table III shows a borderline failing Caterpillar 1H2 diesel engine test. I believe the borderline failing score in this test should be overcome by prudent adjustment of reaction conditions and lubricant formulation. The 1% top groove fill deposit is very good.

The foregoing specification, examples, and tables of data are illustrative of the invention. However, since many embodiments of the invention can be made the invention resides wholly in the claims hereinafter appended.

I claim:

1. An improved sulfurized aminated olefin dispersant composition substantially noncorrosive to engine surfaces which comprises the product of the reaction of:

(a) an olefin having about 10 to 10,000 carbon atoms and 0.1 to 20.0 moles of a sulfur or a sulfur-yielding compound per mole of olefin to form a sulfurized olefin at about 50° to 500° C., (b) reacting the sulfurized olefin with about 0.1 to 20 moles of a polyamine per mole of olefin, having the formula:

$$H_2N[(CH_2)_zNH]_xH$$

wherein z is an integer of 2 to 6 and x is an integer of 1 to 10 to form an aminated sulfurized olefin, at about 50° to 400° C., and (c) reacting the aminated sulfurized olefin with about 0.1 to 10 moles of a boron compound, comprising a boric acid, a boric acid salt or a boron oxide, and about 0.1 to 10 moles of formaldehyde or a formaldehyde-yielding compound each per mole of olefin at about 50° to 300° C.

2. The composition of claim 1 wherein the olefin comprises a substantially amorphous polyolefin.

3. The composition of claim 2 wherein the substantially amorphous polyolefin is a polyisobutylene polymer, a polybutene polymer, an ethylene-propylene copolymer, an ethylene-propylene-diene terpolymer, or mixtures thereof.

4. The composition of claim 3 wherein the ethylene-propylene-diene terpolymer is an ethylene-propylene-5-ethylidene-2-norbornene terpolymer.

5. The composition of claim 1 wherein the polyamine is tetraethylenepentamine, triethylenetetraamine, diethylenetriamine, ethylenediamine, hexamethylenediamine or mixtures thereof.

6. The composition of claim 1 wherein the formaldehyde-yielding composition is formalin, trioxane, paraformaldehyde or mixtures thereof.

7. A lubricating oil which comprises a major amount of a lubricating base oil and about 0.01 to 20 percent by weight based on the oil of the product of claim 1.

* * * * *